US010164328B2

(12) United States Patent
Lu et al.

(10) Patent No.: US 10,164,328 B2
(45) Date of Patent: Dec. 25, 2018

(54) METHOD AND APPARATUS FOR OPTICAL AGITATION OF ELECTROLYTES IN A FLUID-BASED ANTENNA

(71) Applicant: The United States of America as Represented by the Secretary of the Navy, Washington, DC (US)

(72) Inventors: Ryan P. Lu, San Diego, CA (US); Vincent V. Dinh, San Diego, CA (US); Bienvenido Melvin L. Pascoguin, La Mesa, CA (US); Ayax D. Ramirez, Chula Vista, CA (US)

(73) Assignee: The United States of America as represented by Secretary of the Navy, Washington, DC (US)

( * ) Notice: Subject to any disclaimer, the term of this patent is extended or adjusted under 35 U.S.C. 154(b) by 210 days.

(21) Appl. No.: 15/259,244

(22) Filed: Sep. 8, 2016

(65) Prior Publication Data

US 2018/0069310 A1 Mar. 8, 2018

(51) Int. Cl.

| | |
|---|---|
| ***H01Q 1/06*** | (2006.01) |
| ***H01Q 1/34*** | (2006.01) |
| ***H01Q 1/10*** | (2006.01) |
| ***H01Q 9/34*** | (2006.01) |

(52) U.S. Cl.
CPC ..... *H01Q 1/34* (2013.01); *H01Q 1/10* (2013.01); *H01Q 9/34* (2013.01)

(58) Field of Classification Search
CPC ..... H01Q 5/22; H01Q 1/34; H01Q 3/46
USPC ..... 343/721
See application file for complete search history.

(56) References Cited

U.S. PATENT DOCUMENTS

| | | | |
|---|---|---|---|
| 4,498,086 | A | 2/1985 | Sandler |
| 5,633,648 | A | 5/1997 | Fischer |
| 5,886,661 | A | 3/1999 | Harrison et al. |
| 6,492,956 | B1 | 12/2002 | Fischer et al. |
| 6,674,970 | B1 | 1/2004 | Anderson |
| 6,859,189 | B1 | 2/2005 | Ramirez et al. |
| 7,262,734 | B2 | 8/2007 | Wood |
| 7,898,484 | B1 | 3/2011 | Tam |
| 7,969,370 | B1 | 6/2011 | Dinh et al. |

(Continued)

OTHER PUBLICATIONS

Condliffe, "Mitsubishi Has Made an Antenna Out of Seawater," Gizmodo, http://gizmodo.com/mitsubishi-has-made-an-antenna-out-of-seawater-175564, Jan. 28, 2016.

(Continued)

*Primary Examiner* — Huedung X Mancuso
(74) *Attorney, Agent, or Firm* — SPAWAR Systems Center Pacific; Kyle Eppele; Susanna J. Torke

(57) ABSTRACT

A method and fluid antenna apparatus are disclosed that incorporate optical agitation of electrolytes. The fluid antenna comprises a substantially enclosed container having a transparent window, an electrolytic fluid disposed within the substantially enclosed container, a light source, the light source producing an optical beam, wherein the light source is configured to direct the optical beam into the container; wherein the transparent window is configured to receive the optical beam from the light source; and wherein the beam has sufficient intensity to enable movement of charged particles in the electrolytic fluid in the container via radiation pressure.

18 Claims, 5 Drawing Sheets

(56) References Cited

U.S. PATENT DOCUMENTS

| | | | | |
|---|---|---|---|---|
| 7,994,992 | B1 | 8/2011 | Tam et al. | |
| 8,164,534 | B1 | 4/2012 | Tam et al. | |
| 8,368,605 | B1 | 2/2013 | Tam | |
| 9,231,300 | B1 * | 1/2016 | Tam | H01Q 1/48 |
| 2004/0060162 | A1 | 4/2004 | Moren | |

OTHER PUBLICATIONS

Pavlus, "Navy Antenna Using Seawater instead of Metal," MIT Technology Review, https://www.technologyreview.com/s/421741/navy-antenna-using-seawater-instead-of-metal, Nov. 28, 2010.

* cited by examiner

METHOD AND APPARATUS FOR OPTICAL AGITATION OF ELECTROLYTES IN A FLUID-BASED ANTENNA

STATEMENT OF GOVERNMENT INTEREST

Federally-Sponsored Research and Development

The United States Government has ownership rights in this invention. Licensing inquiries may be directed to Office of Research and Technical Applications, Space and Naval Warfare Systems Center, Pacific, Code 72120, San Diego, Calif., 92152; telephone (619)553-5118; email: ss_pac_f2@navy.mil. Reference Navy Case No. 102,683.

CROSS-REFERENCE TO RELATED APPLICATIONS

N/A.

BACKGROUND OF THE INVENTION

Field of Invention

This disclosure relates to antennas, and more particularly, to fluid antennas.

Description of Related Art

In many situations, the available real estate for placement of antennas is limited. In a shipboard environment, real estate is a precious commodity, especially at the top-side of the ship. A mid-sized ship may have somewhere in the range of fifty (50) or more antennas to provide the necessary communication and tactical capabilities. Thus, an on-going tradeoff occurs between the available real estate on the ship versus the number of antennas desired for deployment on the ship. As a result, a need exists for an antenna with a relatively small footprint. It may also be desirable for the antenna to be flexible enough to be significantly reduced in size when un-deployed, versus deployed.

Another issue is that some antennas have fixed metal as the primary radiating surface. Therefore, even in the non-active mode, the surface of the antenna may reflect energy. The reflected energy may be sourced from another vessel. The reflected energy may render the ship visible to the other vessel's radar. Under certain circumstances, this visibility on another vessel's radar may be undesirable. Therefore, there is a need for an antenna system that can provide a low or non-existent signature when in a non-operational mode.

Fluid antennas may be compact and may provide a low or non-existent signature when in a non-operational mode. However, charged particle motion in a fluid antenna is necessary for sufficient performance. In an open system, a narrow flowing stream of sea-water has been shown to work as an antenna.

However, customized electrolytic solutions have shown better performance than sea-water. Running expensive custom solutions in an open system can become very costly, very fast. Thus, there is a need for a more flexible, more reliable, relatively inexpensive, closed system for fluid antennas.

BRIEF SUMMARY OF DISCLOSURE

The present disclosure addresses the needs noted above by providing a method and apparatus for optical agitation of electrolytes in a fluid-based antenna.

In accordance with one embodiment of the present disclosure, a fluid antenna is provided that incorporates optical agitation of electrolytes via radiation pressure. The antenna comprises an electrolytic fluid disposed within a substantially enclosed container. The antenna further comprises a light source, the light source producing an optical beam having sufficient intensity to enable movement of charged particles in the electrolytic fluid in the substantially enclosed container via radiation pressure. The antenna further comprises a transparent window configured to receive the optical beam from the light source.

These, as well as other objects, features and benefits will now become clear from a review of the following detailed description of illustrative embodiments and the accompanying drawings.

DETAILED DESCRIPTION OF THE DISCLOSURE

The present disclosure provides a light source that is focused into a substantially enclosed container of electrolytic fluid to induce agitation or stirring motion of the electrolytes via optical radiation pressure.

The process described herein, in the most general embodiment, is a light source with its optical beam directed into a substantially enclosed, non-metallic container filled with an electrolytic fluid. Examples of non-metallic containers can be plastics such as Polyvinyl Chloride (PVC), Polycarbonate, Polyethylene, and Polypropylene. The radiation pressure from the optical beam will induce fluid agitation or stirring action that will enable movement of the charged particles suspended in the fluid. The electrolytic motion is conducive to improved performance of liquid antennas. Optical beam agitation, stirring or mixing allows the apparatus to be free from mechanical parts, increasing the reliability of the system and reducing maintenance cost.

Figure 1:
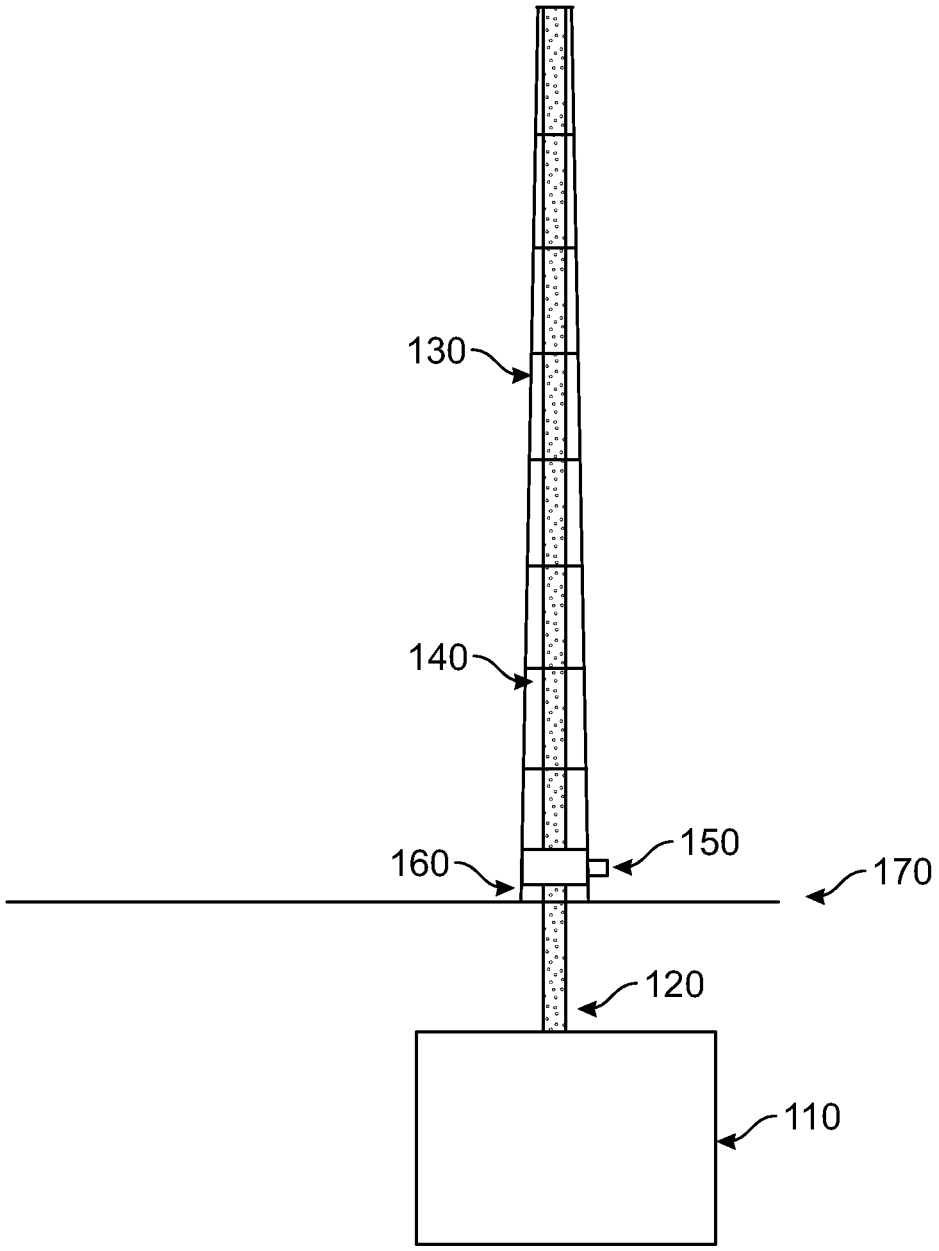
FIG. 1 is a schematic of a fluid antenna with an optical beam that is fired directly into a container, in accordance with one embodiment of the present disclosure.

Referring now to FIG. 1, illustrated is a schematic of a fluid antenna in accordance with one embodiment of the present disclosure. In the embodiment of FIG. 1, light source 110 produces an optical beam 120 that may be fired directly into container 130. The collapsible non-metallic container 130 may be substantially enclosed. Container 130 may be extended by filling the cavity with electrolytic fluid 140 via the aperture 150. Aperture 150 may be the only opening in the substantially enclosed container. Aperture 150 or other I/O filling port may permit fluid to be input and output from the container 130.

Because container 130 is substantially enclosed, it may contain only electrolytic fluid 140 that has been optimized to result in the necessary agitation, stirring or mixing of the charged particles of fluid 140. In order for the fluid 140 to be optimized, it may be desirable for the electrolytic fluid 140 to reach a desired conductivity or have other properties known to those skilled in the art. If the electrolytic fluid 140 has a uniform conductivity, it may generate a desired radiation pattern. Because the container 130 may be substantially enclosed, there is no need to rely solely on sea water. Electrolytic fluid 140 may be comprised of silicon particulates and water, salt and water, or other mixture capable of having charged particles.

Light source 110 may be a laser that produces a vertical beam 120 that is directed into the enclosed, collapsible, non-metallic container 130. In lieu of being positioned vertically, the light source 110 may produce a beam that is directed horizontally. However, mirrors or other reflective devices may be required in order to direct the beam 120 into the substantially enclosed, collapsible, non-metallic container 130. In the present example, the substantially enclosed, collapsible, non-metallic container 130 is conical or a structure that is shaped like a cone.

Light source 110 may be of any wavelength as long as the light source has sufficient intensity to enable movement of the charged particles in the electrolytic fluid 140 due to radiation pressure. The movement caused by optical radiation pressure may be minimal, as long as there is agitation of the fluid 140. The light source 110 may produce a beam 120 of coherent, monochromatic light (e.g., laser) or incoherent broadband light (e.g., a light emitting diode or LED). If a laser is used, some lasers have sufficient intensity to enable movement of the charged particles. If a particular laser does not have sufficient intensity, it may be focused to a high energy density in order to obtain the desired movement. The light source 110 may be of any pulse duration, including nanosecond, picosecond, femtosecond pulse widths. An important goal in this agitation is to obtain sufficient radiation pressure. Sufficient radiation pressure has been demonstrated in the lab with a focused 500 mJ 308 nm Ultraviolet XeCl Excimer laser beam. A 532 nm Nd:YAG laser was also used to demonstrate sufficient radiation pressure.

An optical beam entry point or window 160 may be transparent to the wavelength of the beam and sealed to be watertight with an O-ring. Window 160 should be transparent to the wavelength of light source 110. The adjacent liquid I/O filling port or aperture 150 can be above or below the ship deck or other mounting surface 170 for the fluid-based antenna apparatus. Assuming sufficient agitation and/or radiation pressure, the salt ions in the electrolytic fluid 140 may be uniformly distributed using this laser-based agitation technique.

Figure 2:
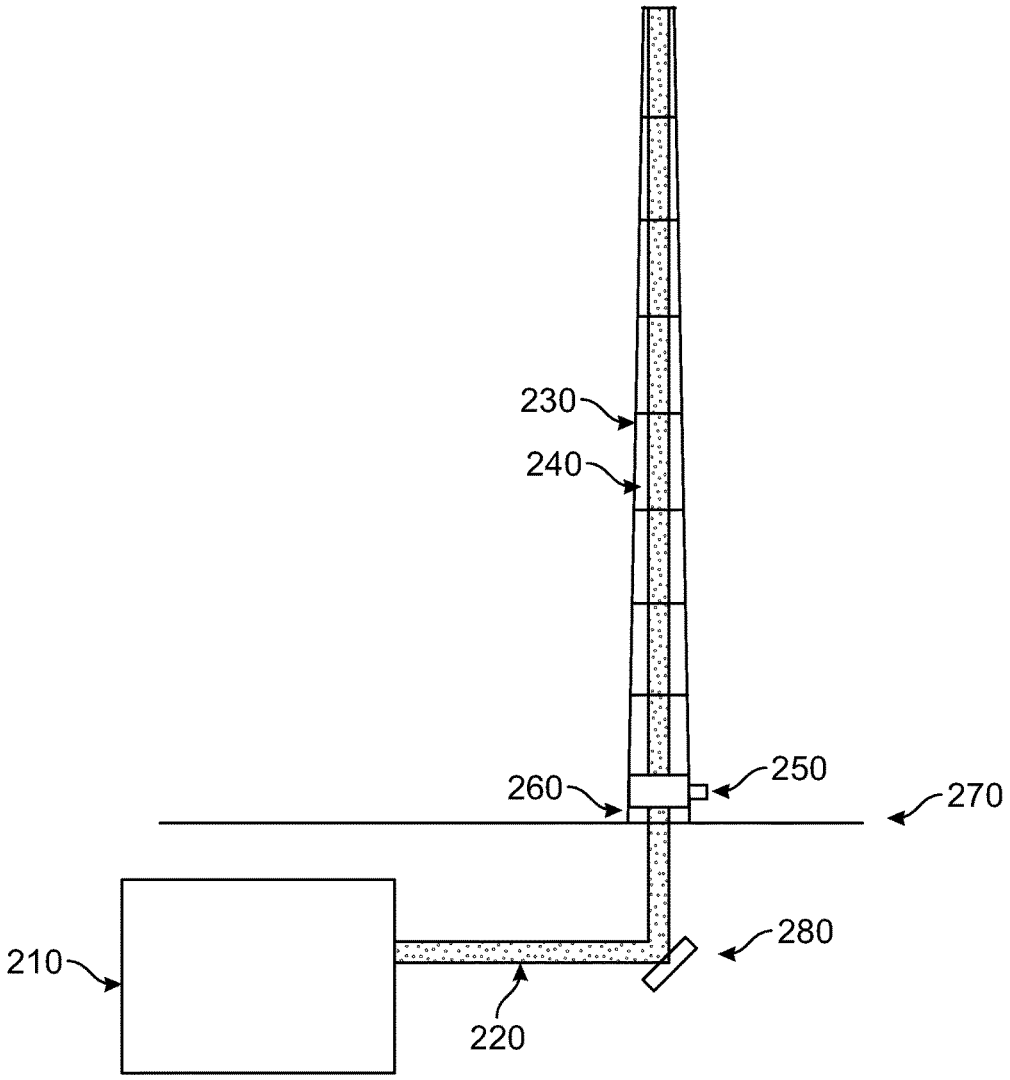
FIG. 2 is a schematic of a fluid antenna with an optical beam that is fired indirectly into a substantially enclosed, collapsible, non-metallic container via an angled mirror, in accordance with one embodiment of the present disclosure.

Referring now to FIG. 2, illustrated is a schematic of a fluid antenna in accordance with the method and apparatus for optical agitation of electrolytes.

IN A FLUID-BASED ANTENNA. Here, the light source 210 produces an optical beam 220 that is fired indirectly into an enclosed, collapsible non-metallic container 230 that contains electrolytic fluid 240.

Aperture 250 or other I/O filling port may be used to insert fluid 240 into the container 230. Other than the aperture 250, the container may be fully enclosed. Or, a stopper or other device may be inserted into aperture 250 in order to seal container 230 so that it is fully enclosed. In the present example, the container 230 is conical, or a structure that is shaped like a cone.

The light source 210 that produces optical beam 220 may be fired into window 260 or other optical beam entry point into the container 230. Window 260 may be mounted onto the ship deck 270, or other mounting surface. Window 260 may be transparent to the wavelength of beam 220. Window 260 may be sealed to ship deck 270 to be watertight. An O-ring may be used for the seal. The liquid I/O filling port 250 or other aperture can be above or below the ship deck 270 or other mounting surface for the antenna.

Before the optical beam 220 is fired into window 260, it may be directed to mirror 280 or other reflective device. In lieu of mirror 280, other reflective apparatuses may be used to re-direct the light source 210. Mirrors or other reflective apparatuses may be desirable for a number of reasons. For example, the use of mirror 280 may enable simpler installation requirements because the optical beam 220 may be redirected and reflected as necessary from the light source 210 so that it is fired directly into the container 230. Here, optical beam 220 is directed horizontally into the mirror 280. In turn, the mirror 280 directs the optical beam 220 vertically into the container 230. Multiple mirrors may be used, including where space limitations may require that the optical beam 220 be directed at a particular angle, or from a particular location, into the container 230.

Figure 3:
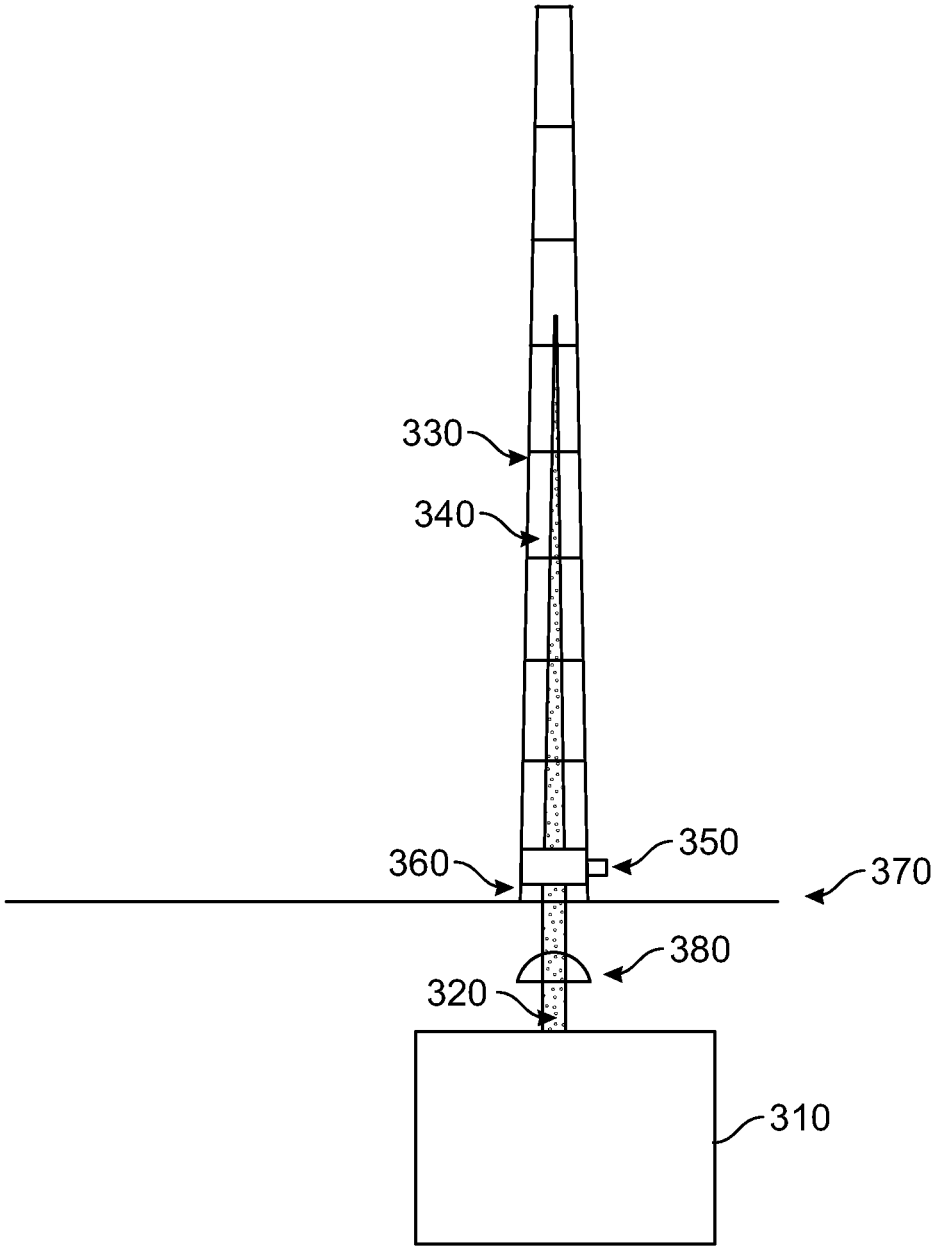
FIG. 3 is a schematic of a fluid antenna with an optical beam that is fired through a focusing lens directly into the collapsible non-metallic container, in accordance with one embodiment of the present disclosure.

Referring now to FIG. 3, illustrated is a schematic of a fluid antenna in accordance with yet another embodiment of the present disclosure. Here, the light source 310 produces optical beam 320. The optical beam 320 is focused to a sharp focal point to generate a beam 320 with a larger energy density than it would have without the focusing lens. Container 330 includes electrolytic fluid 340. The greater energy density of beam 320 intensifies the agitation action of the charged particles in electrolytic fluid 340. The electrolytic fluid 340 may be input into the container 330 via aperture 350. With the larger energy density, the beam 320 need not be directed as far into the container 330. In the present example, the container 330 is conical, or a structure that is shaped like a cone.

Transparent window 360 may be mounted onto a surface 370 such as a ship deck. Before the beam 320 is fired into window 360, the beam 320 is fired through a focusing lens 380 or other focusing device directly into the collapsible non-metallic container 330 via transparent window 360. Using focusing lens 380, light source 310 does not have to be as powerful because the focusing lens 380 may be used to increase the energy's intensity. Multiple focusing lenses may be used to further increase the energy density of the beam.

Figure 4:
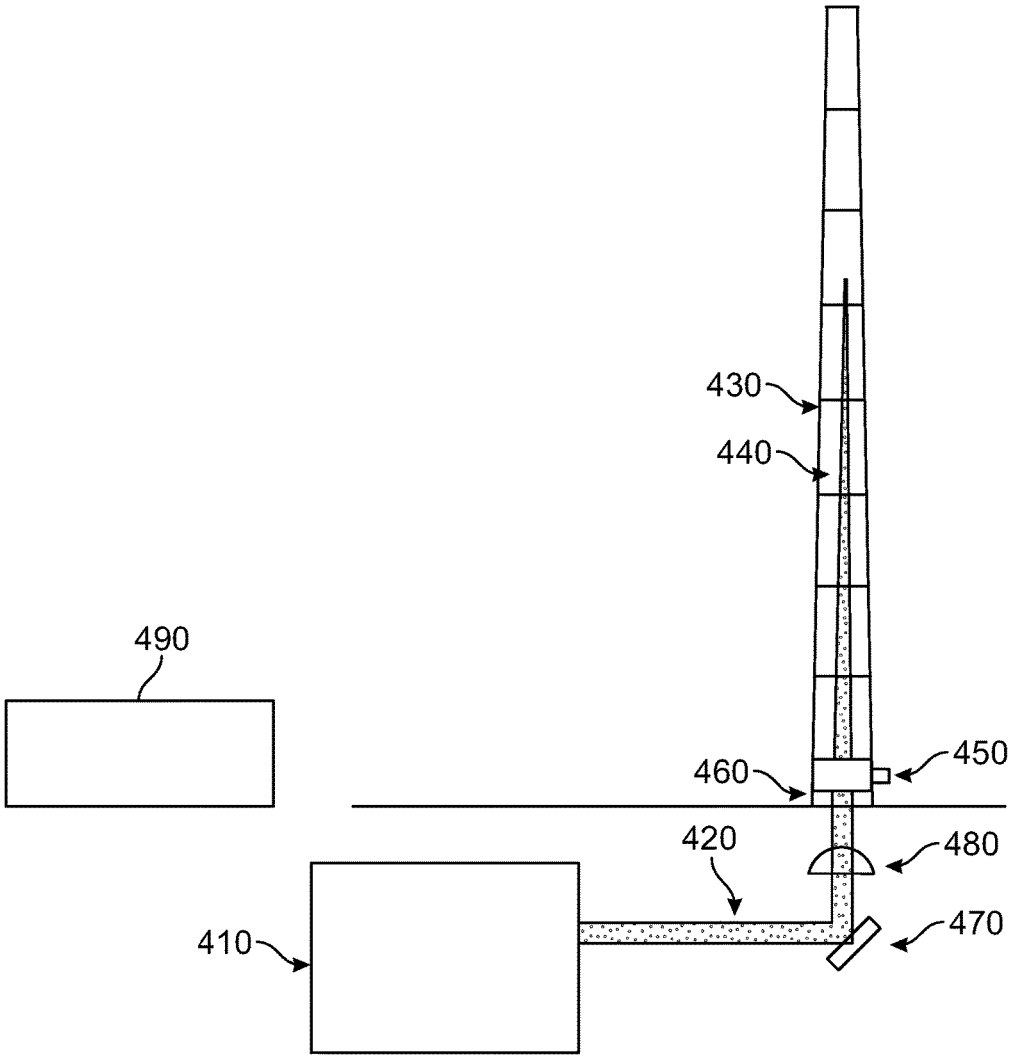
FIG. 4 is a schematic of a fluid antenna with an optical beam that is fired indirectly through a focusing lens via an angled mirror into the collapsible non-metallic container, in accordance with one embodiment of the present disclosure.

Referring now to FIG. 4, illustrated is a schematic of a fluid antenna in accordance with still yet another embodiment of the present disclosure. In this embodiment, light source 410 produces optical beam 420.

In the embodiment of FIG. 4, because the beam 420 is reflected with a mirror, simpler installation requirements are possible. The beam 420 may be directed and re-directed through as many mirrors as necessary so that the beam is directed into the container 430 which may be substantially enclosed. Container 430 includes electrolytic fluid 440. The electrolytic fluid 440 may be input into the container 430 via aperture 450. In the present example, the container 430 is conical, or a structure that is shaped like a cone.

The greater energy density of beam 420 intensifies the agitation action of the charged particles in electrolytic fluid 440. Beam 420 is directed, first through an angled mirror 470, then through a focusing lens 480, and then into the collapsible non-metallic container 430.

A current mast clamp 490 can be used to extract signals from the fluid antenna. The current mast clamp can also be used in any of the previous embodiments shown in FIGS. 1-3. Current mast clamp 490 may read current from the antenna. Examples of current mast clamps can be found in U.S. Pat. No. 8,164,534 issued to Daniel Tam et al. and U.S. Pat. No. 7,994,992 issued to Daniel Tam et al., the contents of which are incorporated herein by reference in their entirety.

Figure 5:
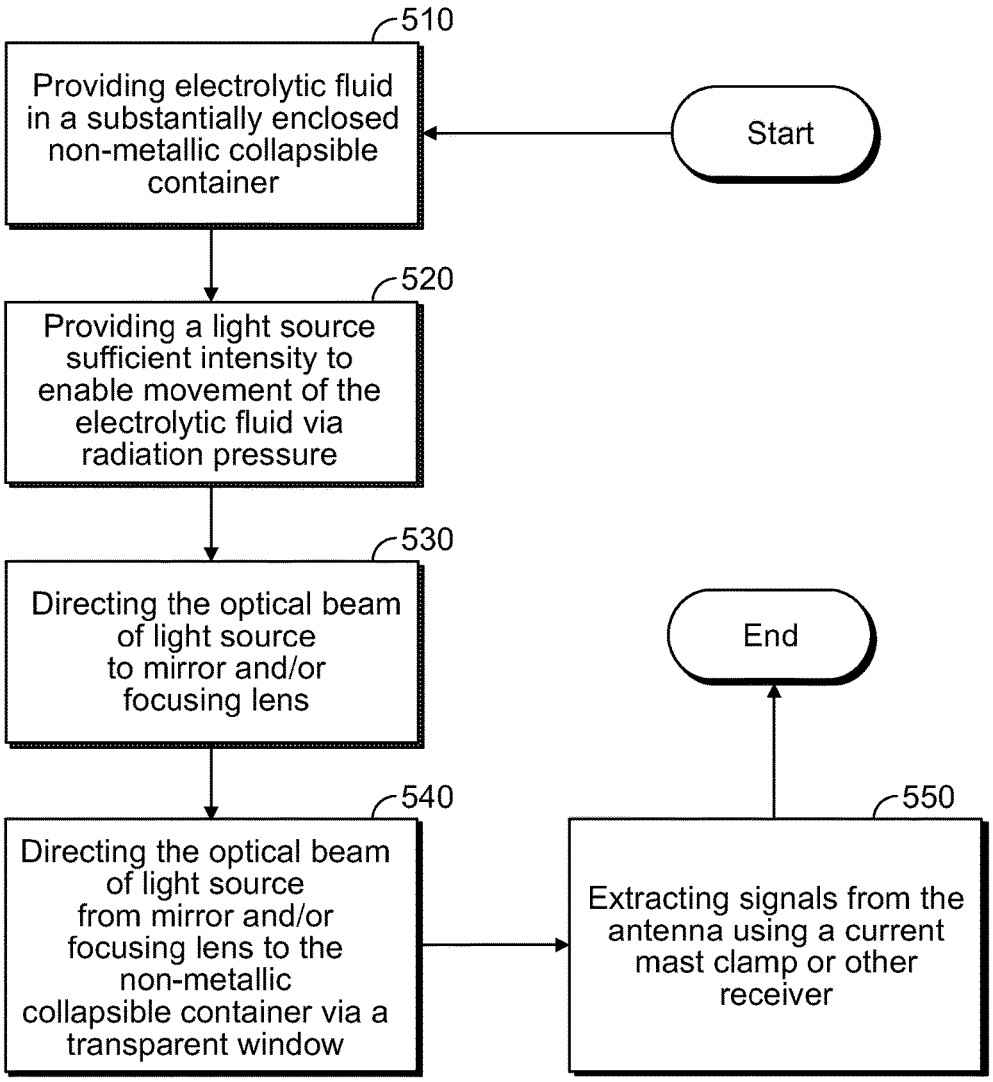
FIG. 5 is a flow chart showing the steps of a method for optical agitation of electrolytes in a fluid antenna in accordance with one embodiment of the present disclosure.

Referring now to FIG. 5, illustrated is a method for optical agitation of electrolytes in a fluid-based antenna. At step 510, electrolytic fluid is provided in a non-metallic collapsible container. At step 520, a light source is provided having sufficient intensity to enable movement of the electrolytic fluid via radiation pressure. At step 530, the optical beam from the light source is directed to a mirror and/or focusing lens. At step 540, the optical beam of the light source is directed from the mirror or focusing lens to the non-metallic collapsible container via a transparent window. In this manner, optical agitation, mixing or stirring of the charged particles in the electrolytic fluid occurs. At step 550, a current mast clamp or other receiver extracts signals from the fluid antenna.

It will be understood that many additional changes in the details, materials, steps and arrangement of parts, which have been herein described and illustrated to explain the nature of the invention, may be made by those skilled in the art within the principle and scope of the invention as expressed in the appended claims.

We claim:

1. A fluid antenna, comprising:
an enclosed collapsible container having a transparent window, the enclosed collapsible container further having a single aperture configured to permit entry and exit of electrolytic fluid, wherein
the electrolytic fluid is disposed within the enclosed collapsible container;
a light source, the light source producing an optical beam, wherein the light source is configured to direct the optical beam into the enclosed collapsible container;
wherein the transparent window is configured to receive the optical beam from the light source; and
wherein an intensity of the optical beam is configured to enable movement of charged particles in the electrolytic fluid in the enclosed collapsible container via radiation pressure.

2. The fluid antenna of claim 1, further comprising:
at least one reflective device configured to receive the optical beam from the light source, and to direct the optical beam into the enclosed collapsible container via the transparent window.

3. The fluid antenna of claim 1, further comprising:
at least one focusing lens configured to receive the optical beam from the light source, and to direct the beam into the enclosed collapsible container via the transparent window.

4. The fluid antenna of claim 1, further comprising:
at least one mirror configured to receive the optical beam from the light source; and
at least one focusing lens configured to receive the optical beam from the at least one mirror and to direct the optical beam into the enclosed collapsible container via the transparent window.

5. The fluid antenna of claim 1, wherein the transparent window is mounted onto a surface and includes a water-tight O-ring seal.

6. The fluid antenna of claim 1 wherein the enclosed collapsible container is non-metallic.

7. The fluid antenna of claim 6, wherein the enclosed collapsible container is a cone structure.

8. The fluid antenna of claim 1, further comprising:
a current mast clamp that extracts signals from the fluid antenna.

9. The fluid antenna of claim 1, wherein the light source produces a coherent monochromatic light beam.

10. A method for optical agitation of electrolytes in a fluid antenna, comprising the steps of:
providing an electrolytic fluid in an enclosed, conical, collapsible, non-metallic container, the enclosed, conical, collapsible, non-metallic container having a single aperture configured to permit entry and exit of the electrolytic fluid;
providing a light source that is configured to enable movement of charged particles in the electrolytic fluid via radiation pressure; and
directing an optical beam from the light source into the enclosed, conical, collapsible, non-metallic container having the electrolytic fluid, thereby causing movement of the charged particles in the electrolytic fluid via radiation pressure.

11. The method of claim 10, wherein the directing step includes two sub-steps:
in a first sub-step, directing the optical beam from the light source to at least one mirror; and
in a second sub-step, directing the optical beam from the at least one mirror into the enclosed, conical, collapsible, non-metallic container.

12. The method of claim 10, wherein the directing step includes two sub-steps:
in a first sub-step, directing the optical beam from the light source to at least one focusing lens; and
in a second sub-step, directing the optical beam from at least one focusing lens to the enclosed, conical, collapsible, non-metallic container.

13. A fluid antenna, comprising:
an enclosed, conical, non-metallic, collapsible container;
an electrolytic fluid disposed within the enclosed, conical, non-metallic, collapsible container, wherein the enclosed, conical, non-metallic, collapsible container has a single aperture configured to permit entry and exit of the electrolytic fluid;
a light source that produces an optical beam that is configured to enable movement of the electrolytic fluid in the enclosed, conical, non-metallic, collapsible container, thereby causing optical movement of charged particles in the electrolytic fluid via radiation pressure;
at least one mirror or focusing lens configured to receive the optical beam from the light source, and to direct the optical beam into the enclosed, conical, non-metallic, collapsible container via a transparent window; and
a current mast clamp that extracts signals from the fluid antenna.

14. The fluid antenna of claim 13, wherein the light source produces an incoherent broadband light beam.

15. The fluid antenna of claim 14, wherein the electrolytic fluid includes salt and water.

16. The fluid antenna of claim 15, wherein the transparent window is mounted onto a ship deck.

17. The fluid antenna of claim 13, wherein the electrolytic fluid includes silicon particulates in water.

18. The fluid antenna of claim 16, wherein the window has a watertight seal to the mounting surface.

* * * * *